US006581212B1

(12) United States Patent
Andresen

(10) Patent No.: US 6,581,212 B1
(45) Date of Patent: Jun. 24, 2003

(54) PROTECTIVE GARMENT

(75) Inventor: Lars Petter Andresen, Oslo (NO)

(73) Assignee: Adtex AS, Oslo (NO)

( * ) Notice: Subject to any disclaimer, the term of this patent is extended or adjusted under 35 U.S.C. 154(b) by 0 days.

(21) Appl. No.: 09/508,738

(22) PCT Filed: May 21, 1999

(86) PCT No.: PCT/NO99/00163

§ 371 (c)(1),
(2), (4) Date: Jun. 6, 2000

(87) PCT Pub. No.: WO00/15063

PCT Pub. Date: Mar. 23, 2000

(30) Foreign Application Priority Data

Sep. 16, 1998 (NO) ..... 19984294

(51) Int. Cl.[7] ..... A41D 19/00

(52) U.S. Cl. ..... 2/167; 2/2.5; 2/161.1; 2/164; 428/911; 139/425 R

(58) Field of Search ..... 2/455, 456, 2.5, 2/167, 22, 161.1, 164, 910, 911, 917; 428/911; 139/425 R

(56) References Cited

U.S. PATENT DOCUMENTS

| | | | | |
|---|---|---|---|---|
| 3,883,898 A | | 5/1975 | Byrnes | |
| 3,916,448 A | * | 11/1975 | Hamel | 2/2.5 |
| 4,004,295 A | | 1/1977 | Byrnes | |
| 4,471,495 A | * | 9/1984 | Kruse et al. | 2/162 |
| 5,087,499 A | | 2/1992 | Sullivan | |
| 5,231,700 A | | 8/1993 | Cutshall | |
| 5,511,241 A | | 4/1996 | Ziegler | |
| 5,894,602 A | * | 4/1999 | Smith et al. | 2/159 |
| 5,903,920 A | | 5/1999 | Granqvist | |

FOREIGN PATENT DOCUMENTS

| | | |
|---|---|---|
| DE | 3023990 A1 | 1/1982 |
| DE | 3805671 A1 | 9/1989 |
| DE | 4341039 A1 | 6/1995 |
| DE | 197 03 481 | 2/1999 |

* cited by examiner

*Primary Examiner*—John J. Calvert
*Assistant Examiner*—Robert H. Muromoto, Jr.
(74) *Attorney, Agent, or Firm*—Kevin Ellicott, Esq

(57) ABSTRACT

A protective garment for protection of body parts against cuts or puncture wounds comprising an inner layer, a protective layer and an outer layer, the protective layer being composed of a wire mesh of woven metal wires, the thickness of the metal wires being between 0.03 mm and 0.20 mm and the apertures in the wire mesh being between 0.05 mm and 0.45 mm.

20 Claims, 3 Drawing Sheets

PROTECTIVE GARMENT

CROSS REFERENCE TO OTHER APPLICATIONS

This is the National Stage filing of PCT NO99/00163 May 21, 1999.

FEDERALLY SPONSORED RESEARCH AND DEVELOPMENT

There are no federally sponsored or funded research or development projects or undertakings in any way associated with the instant invention.

BACKGROUND OF THE INVENTION

1. Field of the Invention

The present invention relates to a protective garment for protecting body parts against cuts and puncture wounds caused by sharp objects such as, e.g., hypodermic needles, fishhooks, broken glass etc., where at least a portion of the garment comprises at least one inner layer, at least one protective layer and possibly one or more outer layers.

2. Background Information

People are exposed to cuts or puncture wounds in many different situations. For cleaning personnel the presence of used hypodermic syringes in public places as well as sharp objects in the rubbish are a common problem. Used syringes and broken glass are also used as a threat in situations where people are under attack, and therefore police, watchmen and other security personnel are exposed to injuries of this kind. Nor is it uncommon to find broken glass at the scene of an accident, and in such places the helpers are in danger of receiving cuts in connection with rescue work. Firemen are particularly exposed to such injury when they have to enter buildings where there is a fire, and where broken glass or other sharp objects may be lying on the ground.

Another situation where it is relevant to use protective clothing is in the field of medical and laboratory work, where sharp objects are employed while blood and other body fluids are also handled with the risk of infection this involves.

Other cases where there is a need for protective clothing are in the fishing industry, where sharp hooks represent a danger, and in the fish processing or meat production business, e.g. slaughterhouses.

The protective garments for use in said and similar such cases should fulfill several requirements. The garments should prevent sharp objects from penetrating them and reaching the skin, they should permit ease of movement when wearing the garments, they should be easy to wash and possibly disinfect, and in general they should be comfortable to use. The latter will lead to the advantage that the garments are always used when there is any risk of injury, and not only in special, highly exposed situations.

There are several known solutions for protective garments where the equipment comprises a protective layer, and in some of these solutions the use of metallic materials is involved. Some of these prior art solutions will be described in the following.

DE-Al-3.023.990 describes a protective glove which is manufactured by braiding or knitting of so-called special steel wire. In a preferred embodiment, the glove is knitted from a steel wire which is enveloped by a textile fiber. The publication also states, however, that the glove can be knitted from uncovered steel wire and subsequently provided with a skin-protecting layer on the inside and a wear layer on the outside. A disadvantage of this glove is that it will be unable to offer the combination of flexibility of use and satisfactory protection against puncture wounds. It is stated that the glove should be made of metal wire in all its parts, both round the fingers, in the palm, and on the back of the hand. If flexibility and mobility are to be achieved with such a glove, it has to be manufactured in large mesh sizes, thus reducing the glove's protective power, especially against penetration of sharp objects.

U.S. Pat. No. 5,231,700 discloses a glove designed to protect medical personnel against cuts and against penetration of hypodermic needles. The glove is woven in its entirety from a yarn which preferably consists of an elastic core of, e.g. Lycra, round which is wound an outer material with great tensile strength such as, e.g. Kevlar. The publication describes the possibility of using metal composites as an additional component in the outer material but this is not recommended on account of reduced sensitivity and mobility. Those portions of the glove which in addition to protecting against cuts and tears are also meant to be resistant to puncture wounds, e.g. from syringes, are further covered with a puncture-impeding layer, which is preferably made of leather. This glove does indeed offer satisfactory protection to medical personnel when dealing with syringes, bone fragments and the like, but is not sufficiently robust to offer adequate protection under critical circumstances such as, e.g. situations involving an attack or handling broken glass. Reinforcing the glove by addition of metal to the material from which the whole glove is made would again result in reduced flexibility and usefulness, as mentioned in the publication.

U.S. Pat. No. 4,004,295 describes a glove which is particularly useful for work in the meat production industry. This is achieved by having the glove made of nonmetallic fiber yarn, preferably Kevlar, reinforced with metallic fiber wires. This design offers good protection against cuts, e.g. from knives, but not against penetration of sharp objects.

DE-3.805.671 discloses a working glove, suitable for deburring metal parts. The glove is made of steel wire with a diameter between 0.2 mm and 0.8 mm, with a mesh between 1 mm 4 mm. It is internally equipped with an inner glove of leather or fabric. This glove is well suited for its application, but unsuitable for protection against penetration of sharp objects, due to the large mesh. Any reduction in the mesh in order to make this glove puncture-proof would make it rigid and immobile, and unsuitable for use.

A protective glove with built-in metal parts is also described in DE-A-4.341.039. The problem of mobility is solved here by the glove comprising several loose metallic parts which together cover the finger's inner surface and which slide over one another when the finger is moved. However, each metallic part is rigid and the mobility is restricted for this reason.

In all the known solutions, mobility and comfort have to be sacrificed for the sake of attaining sufficient protection.

OBJECT OF THE INVENTION

The object of the invention to provide an improved protective garment where the main drawbacks of the previously known solutions are avoided.

SUMMARY OF THE INVENTION

The object is achieved according to the invention with a protective garment of the type mentioned at the beginning, characterized in that at least one protective layer consists of a wire mesh which is composed of metal wires, where the thickness of the metal wire is between 0.03 mm and 0.2 mm and the apertures in the wire mesh are between 0.05 mm and 0.45 mm.

In the preferred embodiment of the invention the wire mesh is woven from metal wires consisting of non-corrosive, stainless steel.

Further advantages are achieved in embodiments as set forth in the claims.

The invention has the surprising effect that it provides good protection with very small dimensions in the wire mesh. This leads both to material savings and to the achievement of substantial mobility when using the protective garment. At the same time the small aperture in the wire mesh prevents thin, sharp objects from penetrating the protective layer. A particularly high degree of protection, with a further reduction in the ability of sharp objects to penetrate the glove, is achieved by using several protective layers of wire mesh.

When used, e.g., in the medical field, it is important that the fine motor mechanism, i.e. the ability to handle small objects and perform small precise movements, should remain unaltered when using protective garments. For this application an especially thin wire mesh should be used.

In a specially preferred embodiment of the invention the protective garment constitutes a glove. The glove consists of an inner layer which is comfortable against the skin (preferably of cotton), one or more protective layers, each consisting of wire mesh, and an outer layer which also provides a certain degree of protection, and which preferably consists of leather. In order to improve mobility while also making the glove lighter, only a few areas of the glove comprise the protective layer of wire mesh. The protective layers cover the palm of the hand and the inner surfaces of the fingers, while the rest of the hand is free from protective layers. The fastening of the various layers to one another is crucial with regard to the glove's flexibility, and in a preferred embodiment the inner layer and the protective layers are joined together by gluing, and the outer layer is sewn together with the inner layer along the glove's natural outer seams or only in the area around the finger tips and/or the wrist. In order to reinforce the glove's protective properties, a greater number of protective layers may be employed in the palm area than in the area covering the inner surfaces of the fingers.

It is also possible to sew or laminate the layers together, or the protective layers may be loosely arranged between the inner and outer layers.

The protective garment according to the invention may be provided in the form of a removable article of clothing for placing directly on the body or on the outside of ordinary clothes. The article consists an inner layer in a soft and comfortable material (e.g. cotton), a number of protective layers consisting of wire mesh and preferably an outer layer in a soft material (e.g. cotton) if the article is intended for use under the clothes as an insert, or possibly of a more hard-wearing material (e.g. leather) if the article is to be used externally. The article is provided with Velcro or other fastening mechanisms which permit swift and easy fastening to the clothes or round the body or a body part.

Where the protective garment according to the invention is a waistcoat or jacket, in a special embodiment it has been found advantageous, but not necessary, to omit fastening the protective layer to the other layers, and instead let it be provided as an insertion between the inner and outer layer.

The protective garment according to the invention, especially in the case of a waistcoat or jacket, may also contain a number of layers of TWARON, KEVLAR or other special material employed in the manufacture of bullet-proof garments. In this case, the garment will not only be bullet-proof, but also resistant to hypodermic needles and other sharp objects.

Hunting wear and motorcycle suits may also be made in the form of protective garments according to the invention. The wire mesh's flexibility and not least its ductility will make the garment highly suited to this use.

The invention will now be described by means of the attached drawings in which:

A DESCRIPTION OF THE DRAWINGS

A DESCRIPTION OF THE PREFERRED EMBODIMENT

Figure 1:
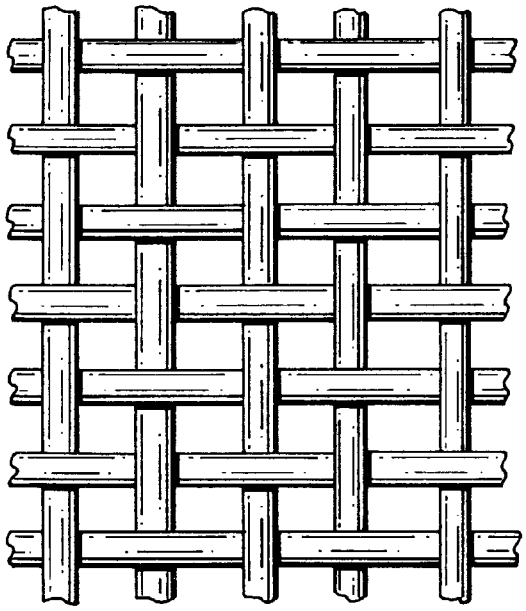
FIG. 1 illustrates two types of wire mesh for use in the invention.

FIG. 1 illustrates sections of two types of wire mesh for use in the invention. In a preferred embodiment, indicated by A, the wire mesh woven in the ordinary manner, and consists of stainless, non-corrosive steel, quality AISI 316. The dimensions of mesh A are 0.05 mm in wire diameter and 0.077 mm in the mesh's aperture. Mesh B shows one of several examples of a wire mesh of an alternative weaving, a so-called Twill weaving, which may be used in wire mesh according to the invention.

Figure 2:
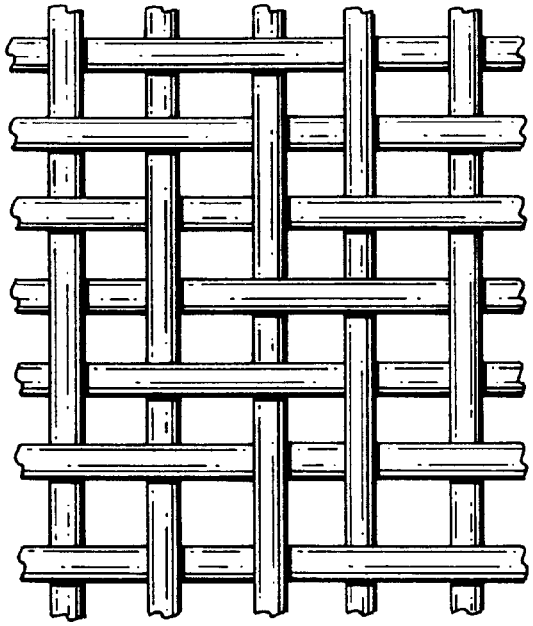
FIG. 2 illustrates the placing of the wire mesh in a glove according to the invention viewed from the side.
Figure 3:
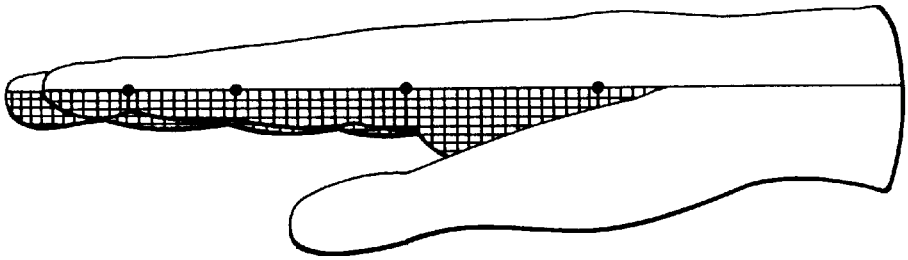
FIG. 3 illustrates the placing of the wire mesh in a glove according to the invention viewed from the palm side.
Figure 4:
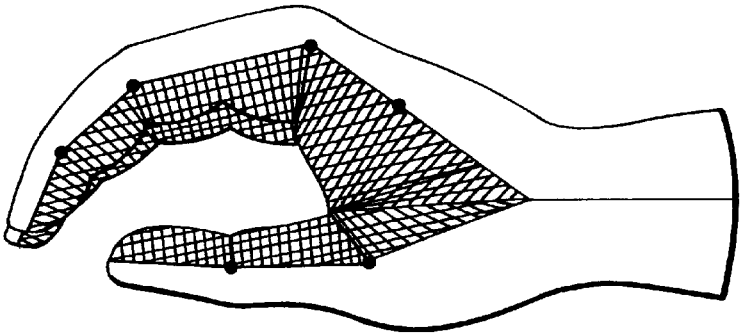
FIG. 4 is a side elevational view of the wire mesh in a glove.
Figure 5:
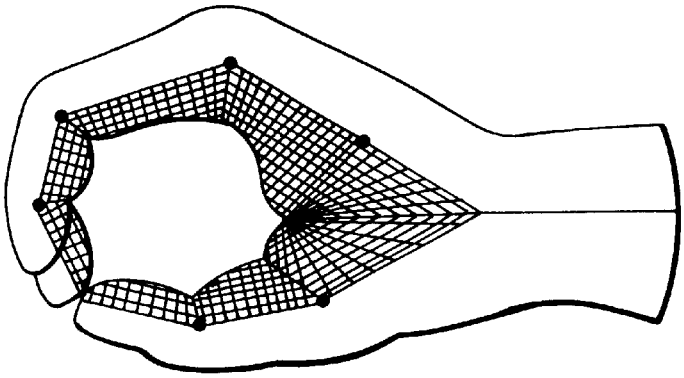
FIG. 5 is a side elevational view of the wire mesh in a glove.
Figure 6:
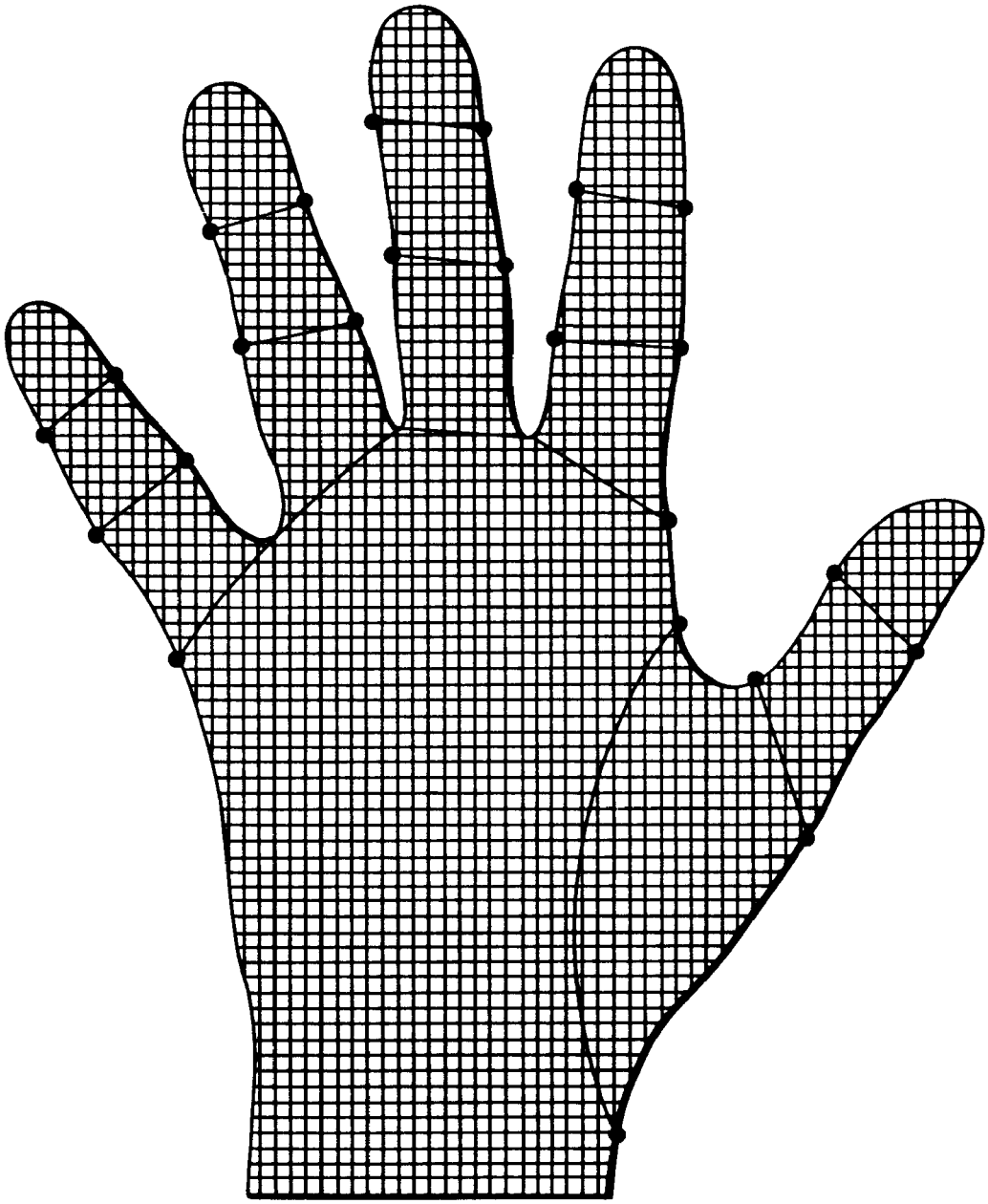
FIG. 6 is a plan view of a glove constructed of the wire mesh.

FIGS. 2 and 3 illustrate the placing of protective layers in a glove according to the invention. The glove comprises an inner layer (not shown) of a fabric material which is comfortable when in contact with the wearer's skin (e.g. leather or a cotton material), a number of protective layers which are composed of wire mesh, and an outer layer (not shown) of a wear-resistant material (e.g. leather).

In the preferred embodiment the inner layer and the protective layers are joined together by gluing, while the outer layer is only fastened to the inner layer only at the fingertips or near the wrist, preferably by means of seams, or by gluing. The outer layer may be fastened at other portions, but particularly along the glove's natural outer seams. It is an advantage if only the protective layer located nearest the inner layer is glued to the innermost layer, and preferably substantially along the entire width of the protective layer. The remaining protective layers may then be fastened to the protective layer located nearest the innermost layer by gluing, taping or the like. The remaining protective layers may be arranged by folding the wire mesh, or alternatively they may be arranged without fastening, particularly in the case where an outer layer is provided on the garment. All the different layers, but particularly the inner layer and the protective layers, may however, be joined in other well-known per se ways, e.g. by means of seams or by lamination.

As illustrated in the drawings, the wire mesh covers the palm of the hand and the inner surface of the fingers. The mesh extends only over a part of the fingers' lateral surfaces, both because it is assumed that the rear surface of the hand (i.e. the back of the hand) will not be exposed to harmful influences to the same extent as the front surface and because good flexibility and mobility are hereby achieved. In covering the palm of the hand, five layers of wire mesh are preferably employed, while two layers are employed for the remaining portions. There are several important reasons for using more layers for the palm than for the fingers. The palm is often the most exposed surface, particularly for severe stresses, and it does not have such a great need for mobility as the fingers. A special factor is that the palm represents a more stable point of support in the case of, e.g., a puncture stress, while it will be easier for the fingers to yield and bend away. The palm should therefore be more heavily protected against injury than the finger portions.

The mesh which is employed in this embodiment of the invention is preferably a wire mesh of the type designated by A in FIG. 1. The illustrated wire mesh is woven in the ordinary way, the warp wires (the longitudinal wires) and the weft wires (the transverse wires) passing over and under one another every other time, the warp wires and the weft wires being arranged at a 90° angle. Within the scope of the invention, however, it will be obvious that it will also be possible to use other types of wire mesh known to those skilled in the art, as long as they are covered by the dimensions for thickness and aperture which are defined in the claims. For example, the warp and weft wires may cross one another in a different pattern, such as, e.g., so-called Twill weave as illustrated by B in FIG. 1, where each weft wire first crosses over two, and then under two warp wires, or some of the wires in the weave may have a different thickness to the other wires (e.g. so-called Dutch weave). A further alternative is that the angle between the warp and weft wires can deviate from the preferred 90°, preferably being between 30° and 150° (so-called pantographed weave).

For a person skilled in the art it is also obvious that the metal wires which form the wire mesh may each consist of a single filament, so-called monofilament wire, or several filaments which, e.g., are intertwined, so-called multifilament wire. Both of these alternatives thus lie within the scope of the invention. In the latter case the dimensions which are related to the wire will apply to the wire viewed as a whole, and not each filament individually.

The metal wires preferably consist of non-corrosive, stainless steel. Among the alternative materials which will be obvious to a person skilled in the art we may mention here galvanized steel; ferroalloys with carbon, chromium; nickel and nickel alloys with copper, chromium and/or iron; and titanium.

The wire mesh may be arranged so as to form any angle whatever between the wire mesh's wires and the main direction of the seams in the protective garment. In the preferred embodiment of a protective glove the wire mesh is provided so that the warp or weft wire is parallel to the longitudinal direction of the glove.

It has been shown to be advantageous to employ at least two layers of wire mesh as a protective layer, and additional layers where necessary with a view to resistance to puncture and injury. However, it is within the scope of the invention to employ any number of layers, at least one, for wire mesh as a protective layer.

The different protective layers of wire mesh may be of an identical type, or they may be different, provided at least one of the protective layers is designed according to the invention, with dimensions as indicated in the patent claims.

Each protective layer is preferably made of wire mesh with the same design and wire dimensions along the full extent of the protective layer. Within the scope of the invention, however, a protective layer may instead be made of wire mesh of a different design and different wire dimensions in different portions of the protective layer.

The inner layer is preferably made of a cotton material, but alternatively it may be of a different material which has properties which make it suitable for placing directly against the skin, including synthetic fabrics, leather, wool, and various textile mixtures, which may, e.g., be knitted or woven and sewn.

The optional outer layer preferably consists of leather, but alternatively it may be another hard-wearing material of appropriate softness, tensile strength and resistance to the external conditions to which it may be assumed the garment will be exposed in each individual case. Thus the outer layer may alternatively consist of natural or synthetic fabric, or a combination thereof, which may, e.g. be knitted or woven and sewn, or possibly made of rubber or a soft synthetic material.

It will be obvious for a person skilled in the art that there are many possible applications for the invention, including those mentioned in the fields of medicine and laboratory work, the fire service, police, fisheries, military field equipment, hunting equipment, bullet-proof equipment, motorcycle suits, gloves, protective inserts and all the other fields in which there is a need for a mobile, comfortable garment which offers special protection against puncture wounds.

I claim:

1. A protective garment for protection of body parts against cuts or puncture wounds caused by sharp objects, where at least a portion of the garment comprises at least one inner layer, at least one protective layer and possibly one or more outer layers, characterized in that at least one protective layer is composed of a woven wire mesh consisting of metal wires, where the thickness of the metal wires is between 0.03 mm and 0.2 mm and the apertures in the wire mesh are between 0.05 mm and 0.45 mm.

2. A protective garment according to claim 1, characterized in that the wire mesh is woven from metal wires consisting of non-corrosive stainless steel.

3. A protective garment according to claim 1, characterized in that different portions of the garment contain a different number of protective layers of woven wire mesh.

4. A protective garment according to claim 1, characterized in that the garment is a glove, a jacket, a waistcoat or trousers.

5. A protective garment according to claim 1, where the garment is a glove, characterized in that the protective layers of wire mesh cover the whole palm of the hand and parts of the lateral surfaces of the fingers.

6. A protective garment according to claim 5, characterized in that the part of the glove corresponding to the palm of the hand is covered by at least two, and preferably five, protective layers of wire mesh, and that the parts of the glove corresponding to the fingers' inner surfaces are covered by two protective layers of wire mesh.

7. A protective garment according to claim 1, characterized in that the garment is a removable loose part for use on arms or legs, or on other body parts, under or over the clothes.

8. A protective garment according to claim 1, where the garment is a waistcoat or jacket, characterized in that the garment also comprises at least one layer of bullet-proof material.

9. A protective garment according to claim 1, characterized in that the inner layer and outer layer are made of soft and flexible material.

10. A protective garment according to claim 1, at least two of the layers being joined together by gluing, by seams or by lamination.

11. A protective garment according to claim 2, where the garment is a waistcoat or jacket, characterized in that the garment also comprises at least one layer of bullet-proof material.

12. A protective garment according to claim 2, characterized in that different portions of the garment contain a different number of protective layers of woven wire mesh.

13. A protective garment according to claim 12, the garment being a glove, a jacket, a waistcoat or trousers.

14. A protective garment according to claim 12, where the garment is a glove wherein the protective layers of wire mesh cover the whole palm of the hand and parts of the lateral surfaces of the fingers.

15. A protective garment according to claim 14, the part of the glove corresponding to the palm of the hand being covered by at least two, and preferably five, protective layers of wire mesh, and the parts of the glove corresponding to the fingers' inner surfaces being covered by two protective layers of wire mesh.

16. A protective garment for protection of body parts against cuts or puncture wounds caused by sharp objects, the garment having an inner layer, a protective layer, and an outer layer, the protective layer being a woven mesh of metal wires, the metal wires having apertures therebetween, the metal wires having a thickness between 0.03 mm and 0.2 mm.

17. A protective garment according to claim 16, the apertures in the wire mesh being between 0.05 mm and 0.45 mm.

18. A protective garment according to claim 16, the metal wires being monofilament wires.

19. A protective garment according to claim 16, the metal wires being multifilament wires.

20. A protective garment according to claim 16, the metal wires being stainless steel.

* * * * *